US005303626A

United States Patent [19]

Uehara et al.

[11] Patent Number: 5,303,626

[45] Date of Patent: Apr. 19, 1994

[54] CUTTING APPARATUS

[75] Inventors: Tsukasa Uehara, Kawasaki; Masami Kojima, Tokyo, both of Japan

[73] Assignee: Canon Kabushiki Kaisha, Tokyo, Japan

[21] Appl. No.: 788,988

[22] Filed: Nov. 7, 1991

[30] Foreign Application Priority Data

| | | | |
|---|---|---|---|
| Nov. 9, 1990 | [JP] | Japan | 2-302740 |
| Nov. 9, 1990 | [JP] | Japan | 2-302741 |
| Nov. 9, 1990 | [JP] | Japan | 2-302742 |
| Nov. 9, 1990 | [JP] | Japan | 2-302743 |
| Nov. 9, 1990 | [JP] | Japan | 2-302744 |
| Nov. 9, 1990 | [JP] | Japan | 2-302745 |
| Nov. 9, 1990 | [JP] | Japan | 2-302746 |
| Nov. 9, 1990 | [JP] | Japan | 2-302747 |

[51] Int. Cl.[5] ..... B26D 1/03

[52] U.S. Cl. ..... 83/485; 83/620; 83/622; 83/478; 83/451; 83/508; 83/544

[58] Field of Search ..... 83/397, 485, 490, 454, 83/385, 383, 455, 456, 478, 544, 556, 98, 508, 622, 620, 56, 451

[56] References Cited

U.S. PATENT DOCUMENTS

| | | | |
|---|---|---|---|
| 2,321,299 | 6/1943 | Johnson | 83/507 |
| 3,496,817 | 2/1970 | Staats et al. | 83/56 |
| 3,522,752 | 8/1970 | Ford | 83/397 |
| 3,706,251 | 12/1972 | Wheeler et al. | 83/508 |
| 4,257,294 | 3/1981 | Stoveken | 83/485 |
| 4,590,834 | 5/1986 | Sobel | 83/620 |
| 4,665,787 | 5/1987 | Arnold et al. | 83/508 |
| 4,766,515 | 8/1988 | Bollen et al. | 361/234 |
| 4,951,539 | 8/1990 | Buckner | 83/622 |

FOREIGN PATENT DOCUMENTS

| | | | |
|---|---|---|---|
| 0147007 | 7/1985 | European Pat. Off. . | |
| 0196580 | 10/1986 | European Pat. Off. . | |
| 0271116 | 6/1988 | European Pat. Off. . | |
| 6402632 | 9/1965 | Netherlands . | |
| 0896853 | 5/1962 | United Kingdom | 83/455 |

*Primary Examiner*—Eugenia Jones
*Assistant Examiner*—Allan M. Schrock
*Attorney, Agent, or Firm*—Fitzpatrick, Cella, Harper & Scinto

[57] ABSTRACT

A cutting apparatus having a holding member for holding a sheet; a plurality of cutter member for cutting the sheet held by the holding member; and a shifting member engaged by the plurality of cutting member, for shifting the plurality of cutting member in parallel with each other. The shifting member is so designed that it can shift the cutting means without aligning them perpendicular to a cutting direction during the cutting of the sheet.

20 Claims, 13 Drawing Sheets

CUTTING APPARATUS

BACKGROUND OF THE INVENTION

1. Field of the Invention

The present invention relates to a cutting apparatus for cutting an article to be cut by using cutter members.

2. Related Background Art

In the past, when a sheet of paper is cut to a predetermined size, the paper was obtained by cutting all of edges thereof from one to the other. For example, in a cutting apparatus shown in FIG. 13, a sheet of paper 51 rested on a support surface 50 was positioned by an aligner 52 and a paper holder plate 53 and the sheet was cut by means of a cutter blade 55 shiftable along a guide rail 54 from one edge thereof to the other.

However, in the above-mentioned conventional cutting apparatus, since the paper 51 was cut from one edge thereof to the other, it took a long time to align the paper, and thus, it was not possible to cut the paper correctly in a short time. Further, it was difficult to cut the sheet edges smoothly, since the cut edges were rough because of the clearance between the cutter blade 55 and the paper holder plate 53.

SUMMARY OF THE INVENTION

An object of the present invention is to provide a cutting apparatus which can eliminate the above-mentioned conventional drawbacks and wherein a plurality of cutter members are provided on a frame and the cutter members can be shifted without being aligned in a line perpendicular to advancing directions thereof during a cutting operation.

In order to achieve the above object, according to the present invention, there is provided a cutting apparatus wherein an article to be cut is held by a frame and the article is cut by shifting a plurality of cutter members for cutting the article. During the cutting of the article, the cutter members are shifted without being aligned in a line perpendicular to advancing directions of the cutter members. With this arrangement, since the article to be cut is cut by the plurality of cutter members mounted on the frame, it is possible to cut the article correctly in a short time. Further, during the cutting of the article, since the cutter members can be shifted without being aligned in a line perpendicular to advancing directions thereof, it is possible to cut the article such that the cut edge of the article after cutting is removed in a transverse or widthwise direction.

DETAILED DESCRIPTION OF THE PREFERRED EMBODIMENTS

The present invention will now be explained with reference to the accompanying drawings.

First of all, a brief construction of a cutting apparatus according to the present invention will be explained with reference to FIGS. 1 to 5.

Figure 1:
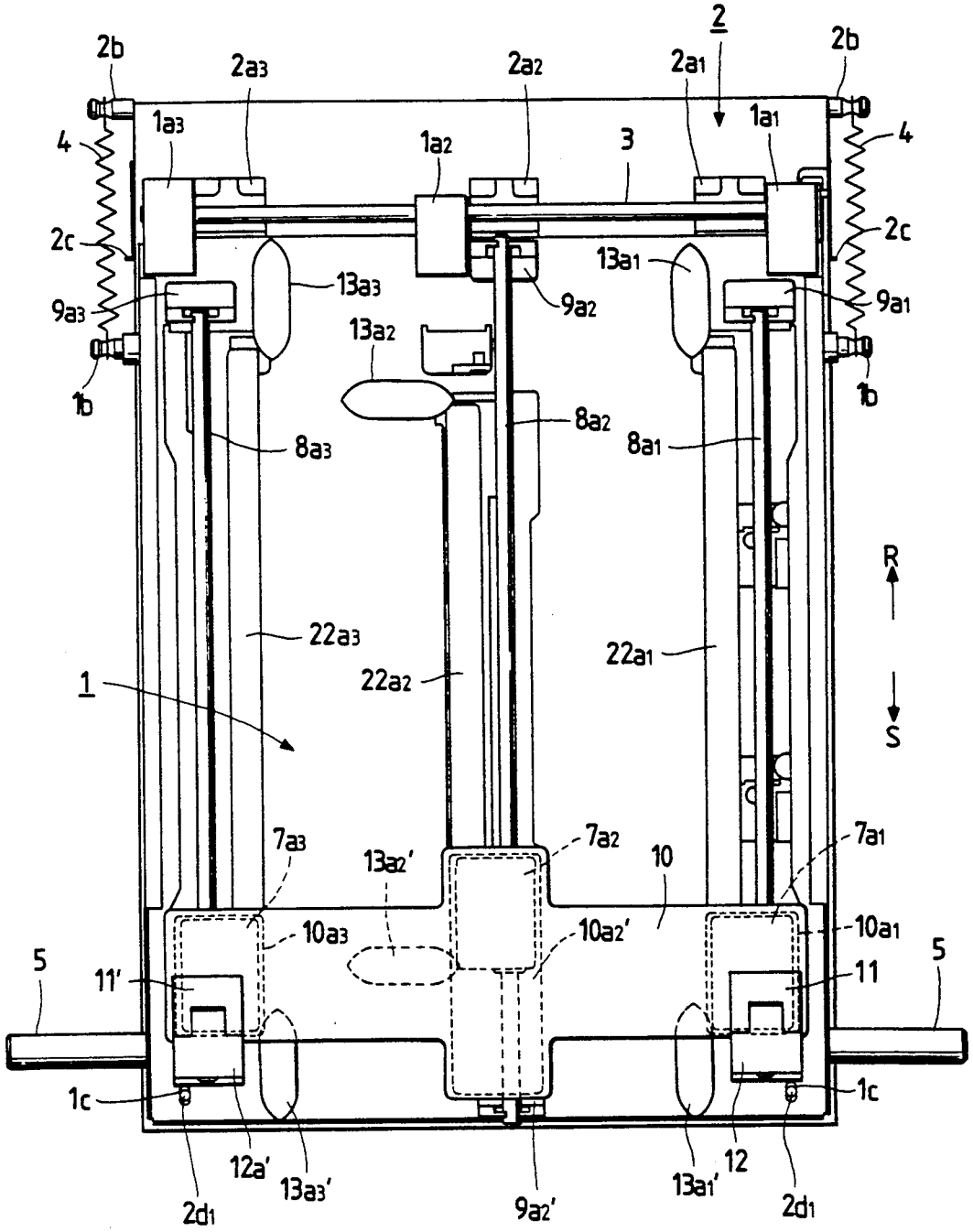
FIG. 1 is a plan view of a frame of a cutting apparatus according to the present invention.
Figure 2:
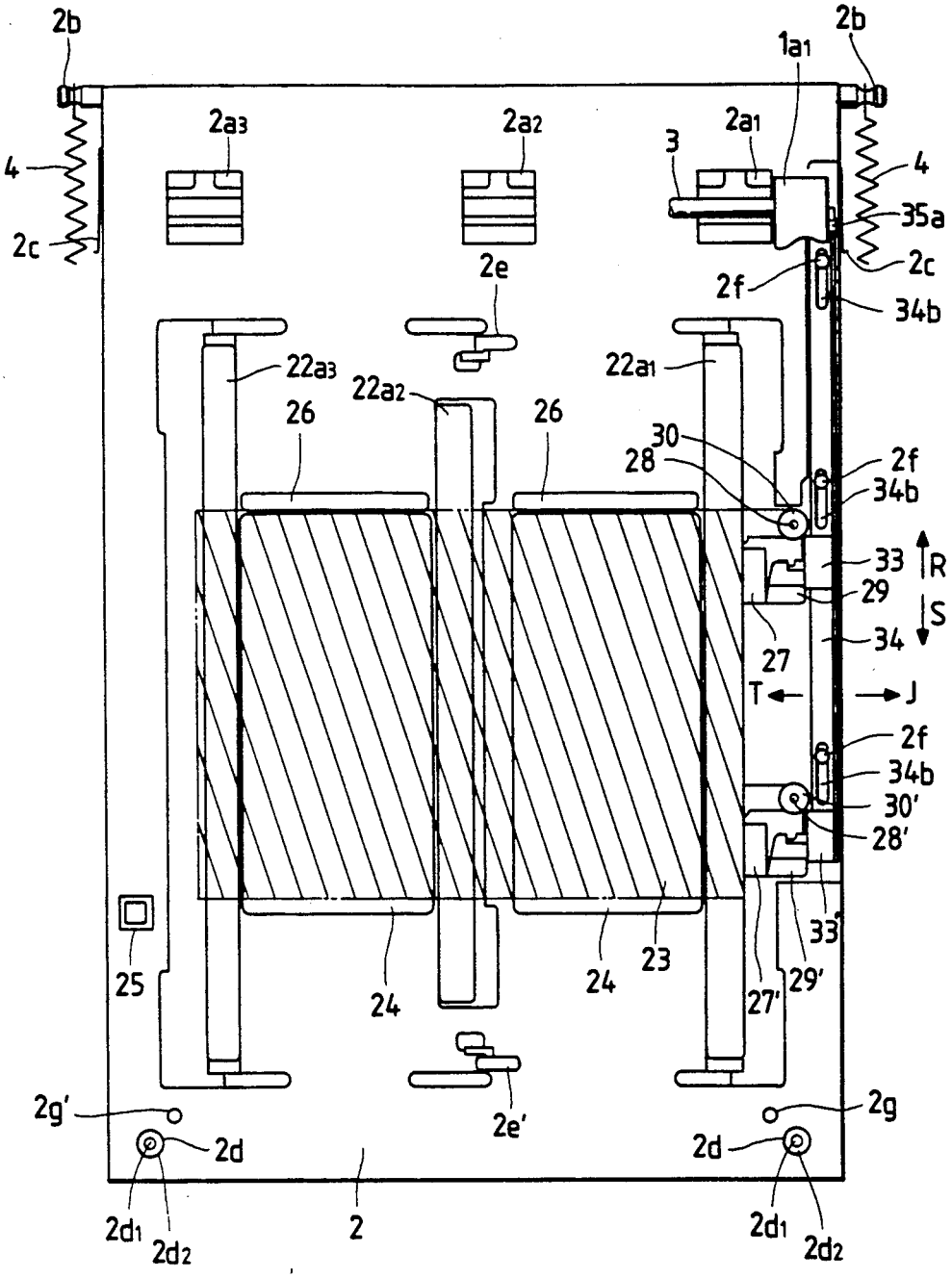
FIG. 2 is a plan view of a support member of the cutting apparatus.

The cutting apparatus according to the present invention comprises a frame 1 having cutter members, and a support member 2 on which an article to be cut is rested. In FIGS. 1 and 2, the frame 1 is rotatably mounted on the support member 2 for rotation around a rotary shaft 3. The rotary shaft 3 is rotatably supported by bearing members $2a_1$, $2a_2$, $2a_3$ (FIG. 7) fixed to the support member 2 and is firmly fitted into bearings $1a_1$, $1a_2$, $1a_3$ attached to the frame 1.

Figure 3:
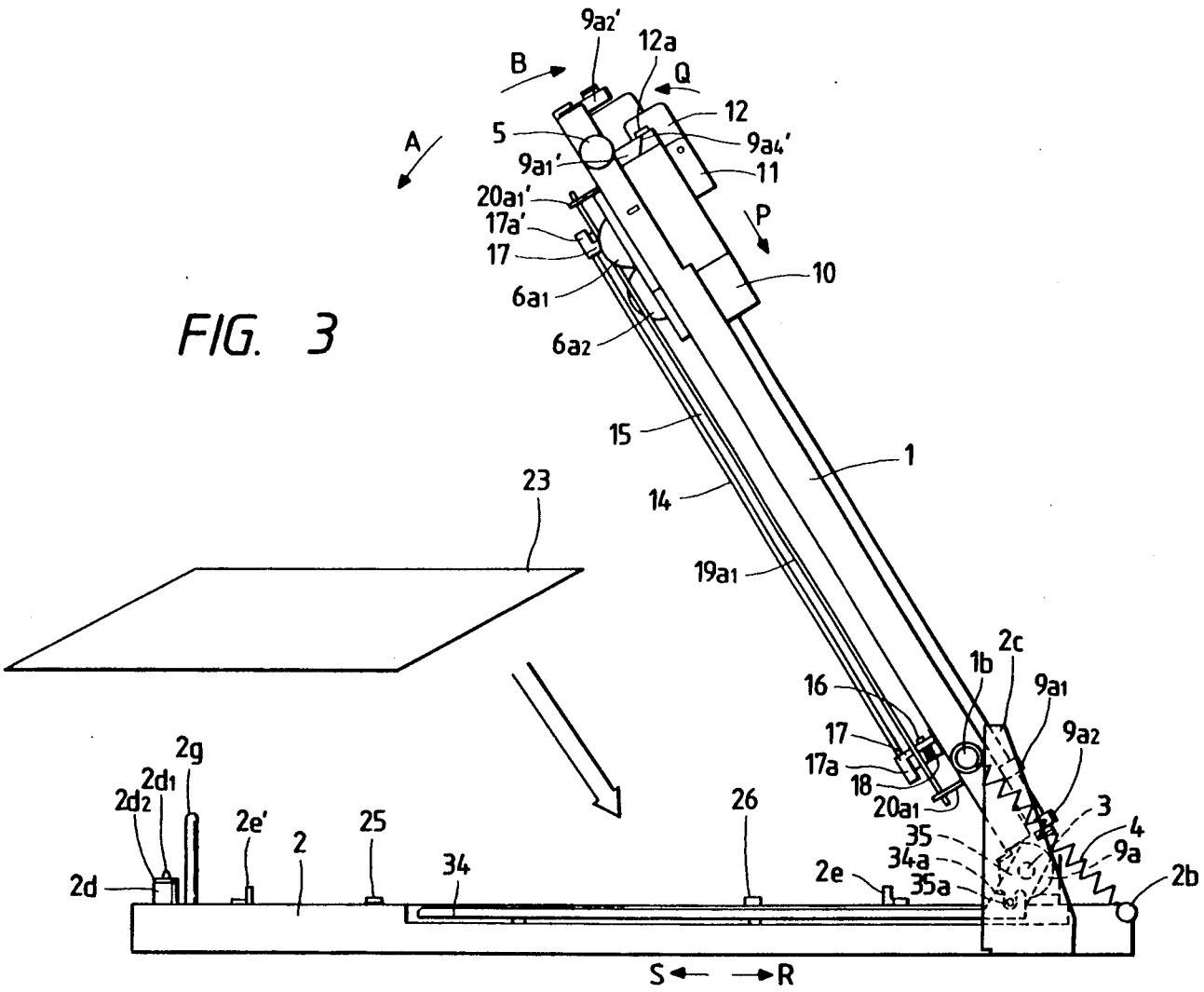
FIG. 3 is a side view showing a condition that the frame is lifted.
Figure 4:
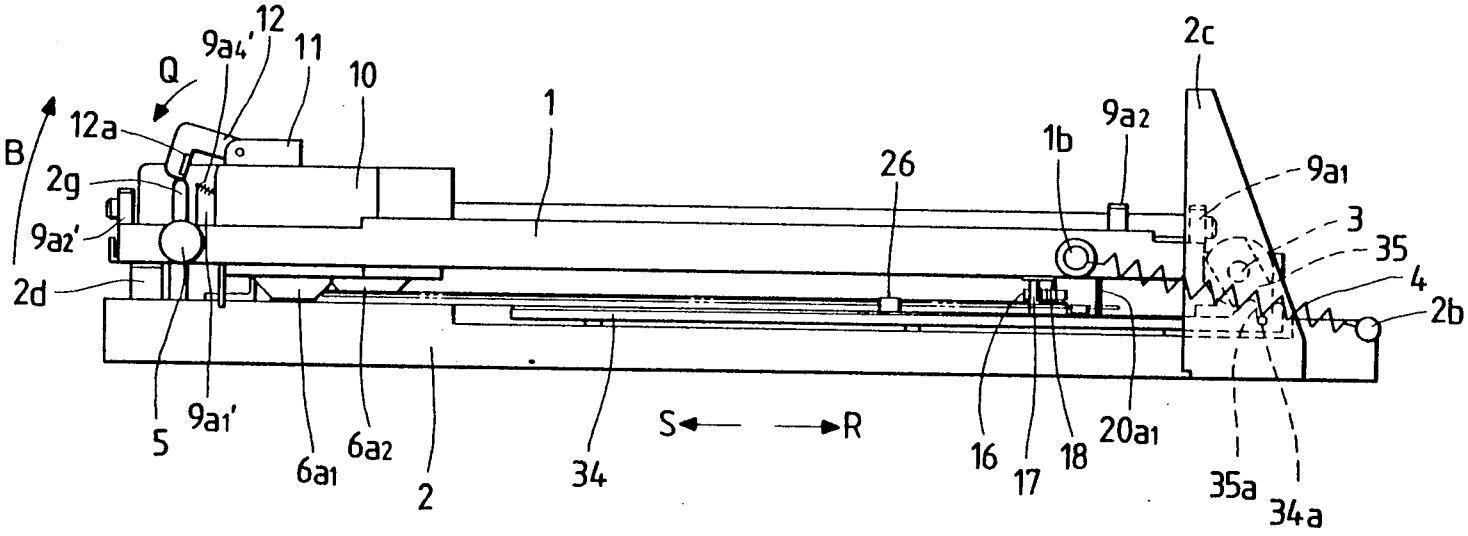
FIG. 4 is a side view showing a condition that the frame is lowered.

Further, the frame 1 and the support member 2 are connected to each other by a spring 4 extending between pins 1*b* and 2*b* formed on the elements 1, 2, respectively, in the vicinity of the rotary shaft 3. A spring force of the spring 4 acts so that it biases the pin 2*b* against a stopper 2*c* formed on the support member when the frame 1 is in a lifted condition (FIG. 3) and it pulls the frame 1 downwardly when the frame is in a lowered condition (FIG. 4). Further, grips 5 are protrudingly formed on both lateral side surfaces of the frame 1 near an end of the frame remote from the rotary shaft 3 to aid the rocking movement of the frame 1 by an operator.

A pair of holes 1*c* are formed in the frame 1 and are loosely fitted onto heads $2d_1$ of corresponding positioning pins 2*d* protruded from the upper surface of the support member 2 when the frame 1 is lowered. Further, as shown in FIG. 2, an elastic member $2d_1$ is attached to a shoulder portion of each positioning pin 2*d* to absorb the shock and to determine the height of the frame 1 when the latter is lowered.

Cutters (cutter members) $6a_1$, $6a_2$, $6a_3$ for cutting the article to be cut are arranged on the frame along its transverse direction. These cutters $6a_1$, $6a_2$, $6a_3$ are held by corresponding cutter holders (holding members) $7a_1$, $7a_2$, $7a_3$, respectively, so that the cutters can be shifted along guide rails $8a_1$, $8a_2$, $8a_3$ extending in a longitudinal direction of the frame 1, respectively. The guide rails $8a_1$, $8a_2$, $8a_3$ are held by bearings $9a_1$, $9a_2$, $9a_3$ near the rotary shaft 3 and by bearings $9a_1$, $9a_2$, $9a_3'$ near the grips 5.

A push holder (movable holder member) 10 serves to integrally hold the cutter holders $7a_1$, $7a_2$, $7a_3$ in corresponding cavities $10a_1$, $10a_2$, $10a_3$ By shifting the push holder 10 in the longitudinal direction (directions R, S in FIGS. 1 and 2), the cutters $6a_1$, $6a_2$, $6a_3$ are operated to cut the article.

Lock arms 12, 12' are attached to both lateral ends of the push holder 10, which lock arms are rotatably supported by holding members 11, 11', respectively. As shown in FIGS. 3 and 4, lock arms 12, 12' are biased toward directions Q by means of corresponding springs (not shown). The push holder 10 is prevented from being shifted in a direction P by frictionally abutting high friction members 12a, 12a' attached to ends of the lock arms 12, 12' against the bearings $9a_1'$, $9a_3'$ of the guide rails $8a_1$, $8a_3$.

Further, lock releasing pins 2g, 2g' are formed on the support member 2, so that, as shown in FIG. 4, when the frame 1 is lowered, the lock arms 12, 12' are engaged by these releasing pins to be rotated in the direction opposite to the direction Q, thereby disengaging the high friction members 12a, 12a' from the bearings $9a_1'$, $9a_3'$. Further, as the push holder 10 is shifted in the direction S, when the lock arms 12, 12' ride over inclined surfaces $9a_4'$ formed on the bearings $9a_1'$, $9a_3'$, the locking condition is released by the lock releasing pins 2g, 2g'. In the condition as shown in FIG. 4, the push holder 10 can be shifted in both directions R and S.

Figure 11:
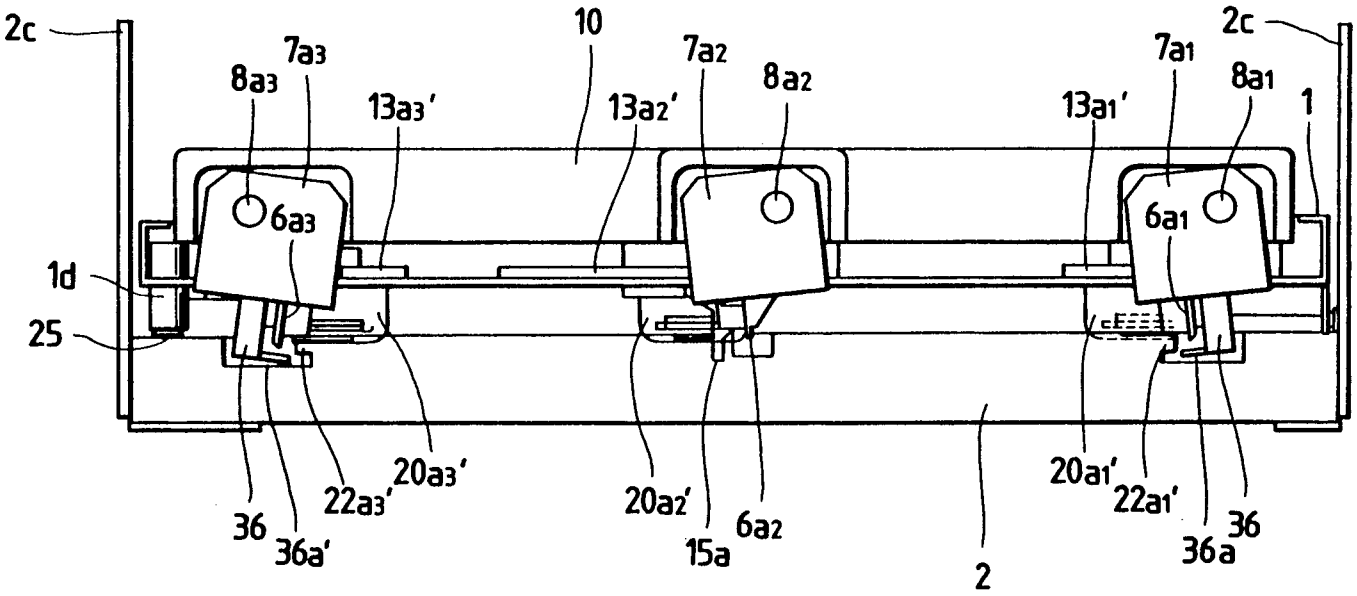
FIG. 11 is an elevational view for explaining the operation of a holding member.

Further, cam members $13a_1$, $13a_2$, $13a_1$ and $13a_1'$, $13a_2'$, $13a_3'$ are provided at cutter waiting positions for the cutters $6a_1$, $6a_2$, $6a_3$ positioned near the rotary shaft 3 and near the grips 5, respectively. With this arrangement, at these cutter waiting positions, the cutters $6a_1$, $6a_2$, $6a_3$ can be brought into the waiting condition by abutting the cutter holders $7a_1$, $7a_2$, $7a_3$ against the cam members $13a_1$, $13a_2$, $13a_3$ and $13a_1'$, $13a_2'$, $13a_3'$ to thereby rotate the cutters around the guide rails $8a_1$, $8a_2$, $8a_3$ (FIG. 11).

Figure 6A:
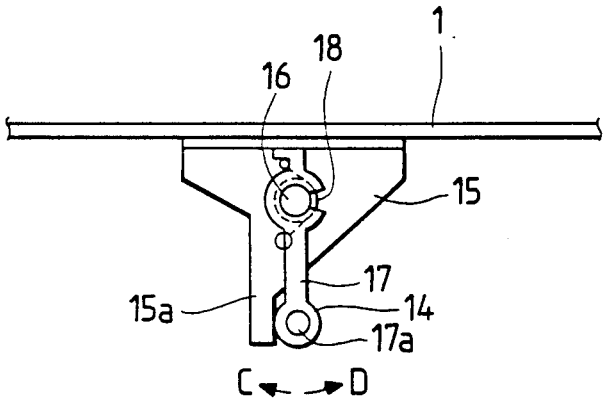
FIGS. 6A and 6B are explanatory views for explaining the operation of a safety bar and a holding member of the frame.
Figure 6B:
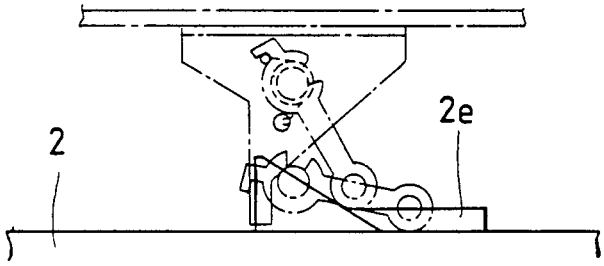
Figure 7:
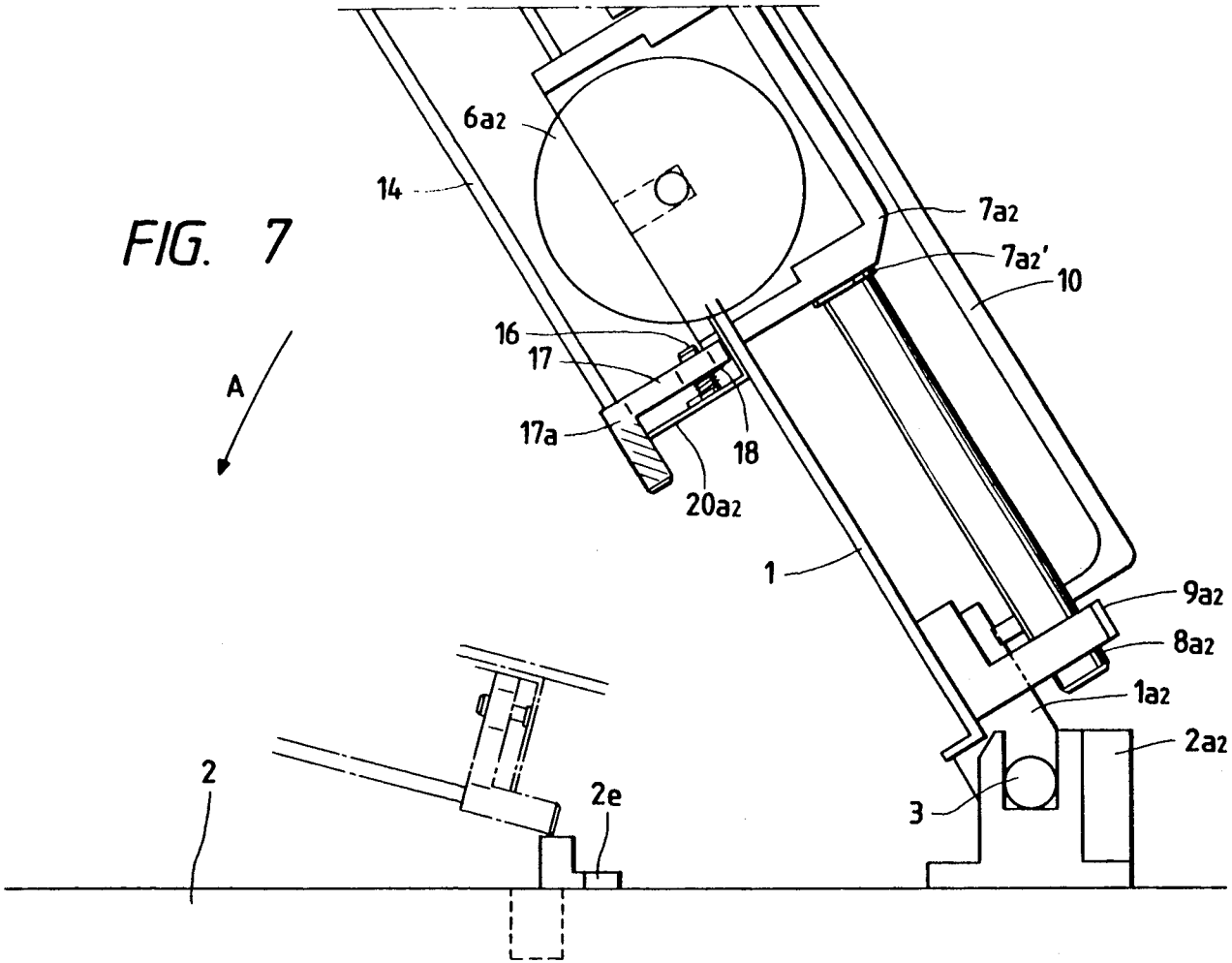
FIG. 7 is a side view of the safety bar and the holding member.

Further, below the central cutter $6a_2$, there is disposed a safety bar 14 acting as a safety member for covering a cutter blade of the central cutter, thereby preventing the operator from touching the cutter blade accidentally. As shown in FIGS. 6A, 6B and 7, the safety bar 14 is held by holding members 17, 17' rotatably mounted on pins 16, 16' protruded from a safety bar holding plate 15 formed on the frame 1, and is biased by torsion coil springs 18, 18' for rotation toward a direction C (FIG. 6A) around the pins 16, 16'.

When the frame 1 is lifted (non-cutting condition), cam portions 17a, 17a' of the holding member 17, 17' are abutted against a stopper portion 15a of the safety bar holding plate 15 by the biasing forces of the torsion coil springs 18, 18', thus protecting the cutter blade of the central cutter $6a_2$. Further, as shown in FIG. 6B, when the frame 1 is lowered, the cam portions 17a, 17a' are rotated in the direction C along inclined surfaces of guide cams 2e, 2e' formed on the support member 2 against the biasing forces of the torsion coil springs 18, 18', thus exposing the cutter blade of the central cutter $6a_2$.

Figure 5:
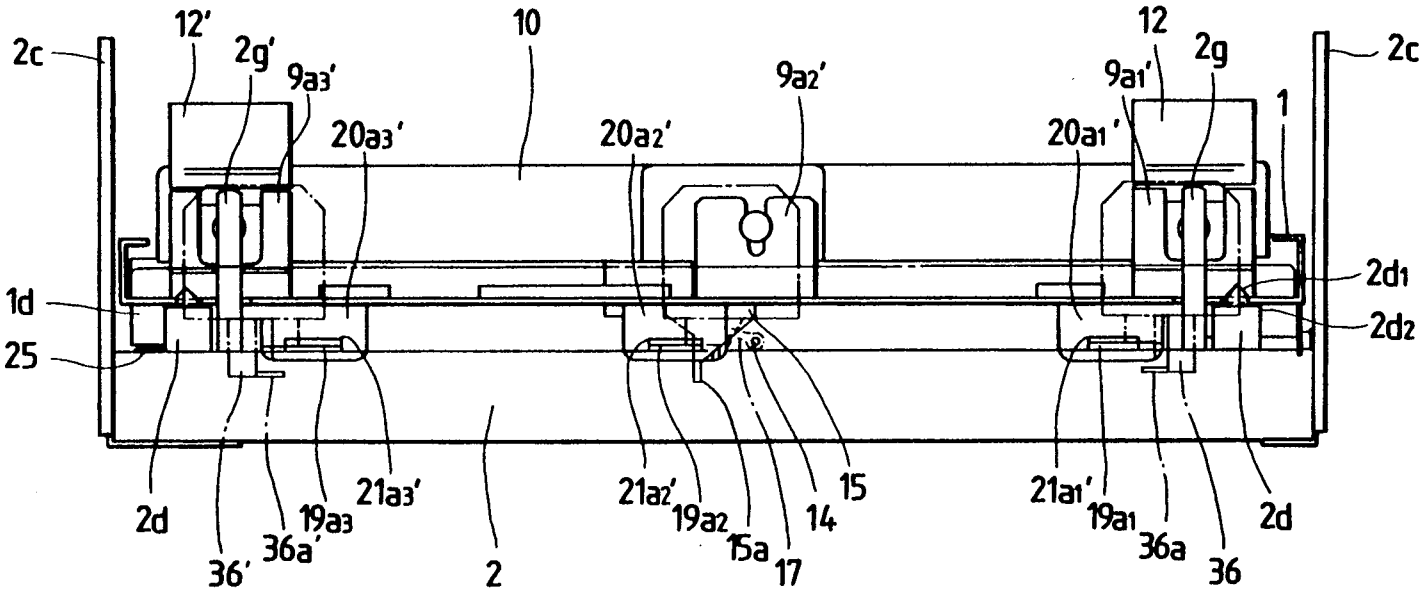
FIG. 5 is an elevational view of the cutting apparatus.

Further, in the vicinity of the cutters $6a_1$, $6a_2$, $6a_3$, holder plates $19a_1$, $19a_2$, $19a_3$ for fixedly holding the article (to be cut) rested on the support member 2 are formed on the frame 1. As shown in FIGS. 3 and 5, these holder plates $19a_1$, $19a_2$, $19a_3$ are supported by inserting both ends thereof into windows $21a_1$, $21a_2$, $21a_3$ and $21a_1'$, $21a_2'$, $21a_3'$ formed in bent members $20a_1$, $20a_2$, $20a_3$ and $20a_1'$, $20a_2'$, $20a'$ suspended from the back surface of the frame 1.

Further, as shown in FIG. 2, guide members $22a_1$, $22a_2$, $22a_3$ acting as guides during the cutting of the article 23 (to be cut) such as a paper are provided on the support member 2 within a range corresponding to the shifting range of the cutters $6a_1$, $6a_2$, $6a_3$ In addition, an electrostatic adsorption plate (adsorption member) 24 for adsorbing and holding the article 23 is provided on the support member 2. The electrostatic adsorption plate 24 is operated by activating a power switch 25 arranged on the support member 2 by means of an urging member 1d formed on the frame 1.

A first aligner 26 and second aligners 27, 27' are provided for positioning the article 23 rested on the electrostatic adsorption plate 24 in its longitudinal direction and transverse direction, respectively. The second aligners 27, 27' are shiftable in directions shown by the arrows T, J in FIG. 12A, as will be described later.

In FIG. 2, pins 28, 28' are protruded from attachment plates 29, 29' secured to the support member 2 and gears 30, 30' are rotatably mounted on the pins 28, 28'. Slide gears 31, 31' have rack portions 31a, 31a' meshed with the gears 30, 30' and also have elongated grooves 31b, 31b' engaged by guide pins 29a, 29a' protruded from the attachment plates 29, 29', so that the slide gears can be shifted to the directions T, J. The slide gears 31, 31' are biased toward the direction T by means of springs 32 extending between pins 29b, 29b' protruded on the attachment plates 29, 29' and pins 31c, 31c' suspended from the slide gears 31, 31', respectively. Further, the slide gears 31, 31' are prevented from being shifted by engaging bent ends 31d, 31d' of the slide gears by notches 29c, 29c' formed in the attachment plates 29, 29'. Racks 33, 33' formed on a slide plate 34 can be meshed with the gears 30, 30'.

Next, the construction of the cutter $6a_1$ will be described with reference to FIGS. 9A and 9B.

The cutter $6a_1$ is rotatably mounted on a shaft $6b_1$ both ends of which are held by the cutter holder $7a_1$. A rubber roller $6b_2$ and a cutter holder member $6b_3$ are provided on either side of the cutter $6a_1$. compression coil spring $6b_4$ with washers $6b_5$ on both ends is disposed between the cutter holder member $6b_3$ and an inner wall of the cutter holder $7a_1$. By the action of the compression coil spring $6b_4$, the cutter $6a_1$, rubber roller $6b_2$ and the cutter holder member $6b_3$ are integrally biased toward a thrust direction (left in FIG. 9A). A washer $6b_5$ is disposed between the rubber roller $6b_2$ and the inner wall of the cutter holder $7a_1$. Thus, as shown in FIG. 9B, the cutter $6a_1$ is abutted against an end $22a_1'$, of the guide member $22a_1$ attached to the support member 2.

Next, a cutting operation for cutting the article to be cut by using the above-mentioned cutting apparatus will be explained.

First of all, as shown in FIG. 3, the article 23 to be cut (such as a paper) is rested on the electrostatic adsorption plate 24 of the support member 2. In this case, the article is positioned in its longitudinal and transverse directions by abutting edges of the article against the first aligner 26 and the second aligners 27, 27'. After the article 23 is rested on the adsorption plate, the power switch 25 is activated to energize the electrostatic adsorption plate 24, thus adsorbing and holding the article 23. In this condition, the operator grips the grips 5 of the frame 1 to rotate the frame around the rotary shaft 3 in the direction A in FIG. 3.

Now, the frame 1 is held stationary by being biased toward the direction B by the spring 4 to abut the pin 1b against the stopper 2c. Thus, although a certain force is required for rotating the frame 1 in the direction A, after the frame has been rotated to a certain extent, since the biasing force of the spring 4 acts in the direction A, the operator does not add the great force to the grips 5. That is to say, the spring 4 acts as a clip spring. When the frame 1 is rotated around the rotary shaft 3, the cutters $6a_1$, $6a_2$, $6a_3$ mounted on the frame 1 are also rotated and lowered toward the support member 2.

As mentioned above, the holes 1c are formed in the frame, and as shown in FIG. 4, when the frame is lowered on the support member, these holes are loosely fitted on the heads $2d_1$ of the pins 2d protruded from the support member 2, thus positioning the frame. Further, the pins 2d can also position the height of the frame 1 thought the shoulder portions formed thereon. In addition, the elastic members $2d_2$ mounted on the shoulder portions can absorb the shock due to the positioning of the frame.

Further, so long as the frame 1 is lifted, the safety bar 14 is disposed below the cutter blade of the central cutter $6a_2$ to cover the latter, thus preventing the operator from touching the cutter blade accidentally. Further, as shown in FIG. 11, the cutter blades of the side cutters $6a_1$, $6a_3$ are protected by safety plates (shift preventing members) 36, 36' held by the cutter holders $7a_1$, $7a_3$.

As the frame 1 is being lowered, as shown in FIG. 6A, the safety bar 14 is biased to be abutted against the stopper portion 15a of the safety bar holding plate 15 by means of the torsion coil springs 18, 18' via the holding members 17, 17', thus still covering the cutter blade of the cutter $6a_2$.

When the frame 1 is further lowered, the cam portions 17a, 17a' of the holding members 17, 17' ride on the inclined surfaces of the guide cams 2e, 2e' of the support member 2, with the result that the cam portions are rotated in the direction D around the pins 16, 16' in opposition to the biasing forces of the torsion coil springs 18, 18'. Consequently, the cutting blade of the central cutter $6a_2$ is exposed so that it can cut the article 23. In this case, the second aligners 27, 27' are retarded toward the direction J in FIG. 2, as will be described later.

When the frame 1 is lowered, as shown in FIG. 5, the holder plates $19a_1$, $19a_2$, $19a_3$ held within the windows $21a_1$, $21a_2$, $21a_3$ and $21a_1'$, $21a_2'$, $21a_3'$ of the bent members $20a_1$, $20a_2$, $20a_3$ and $20a_1'$, $20a_2'$, $20a_3'$ are also lowered, thus loosely holding the article 23. In this condition, when the operator pushes the push holder 10 in the direction R in FIG. 1, the cutter holders $7a_1$, $7a_2$, $7a_3$ are also pushed to the same direction, thus cutting the article 23.

Next, the operations of the cutter holders $7a_1$, $7a_2$, $7a_3$ will be explained with reference to FIG. 8.

Figure 8:
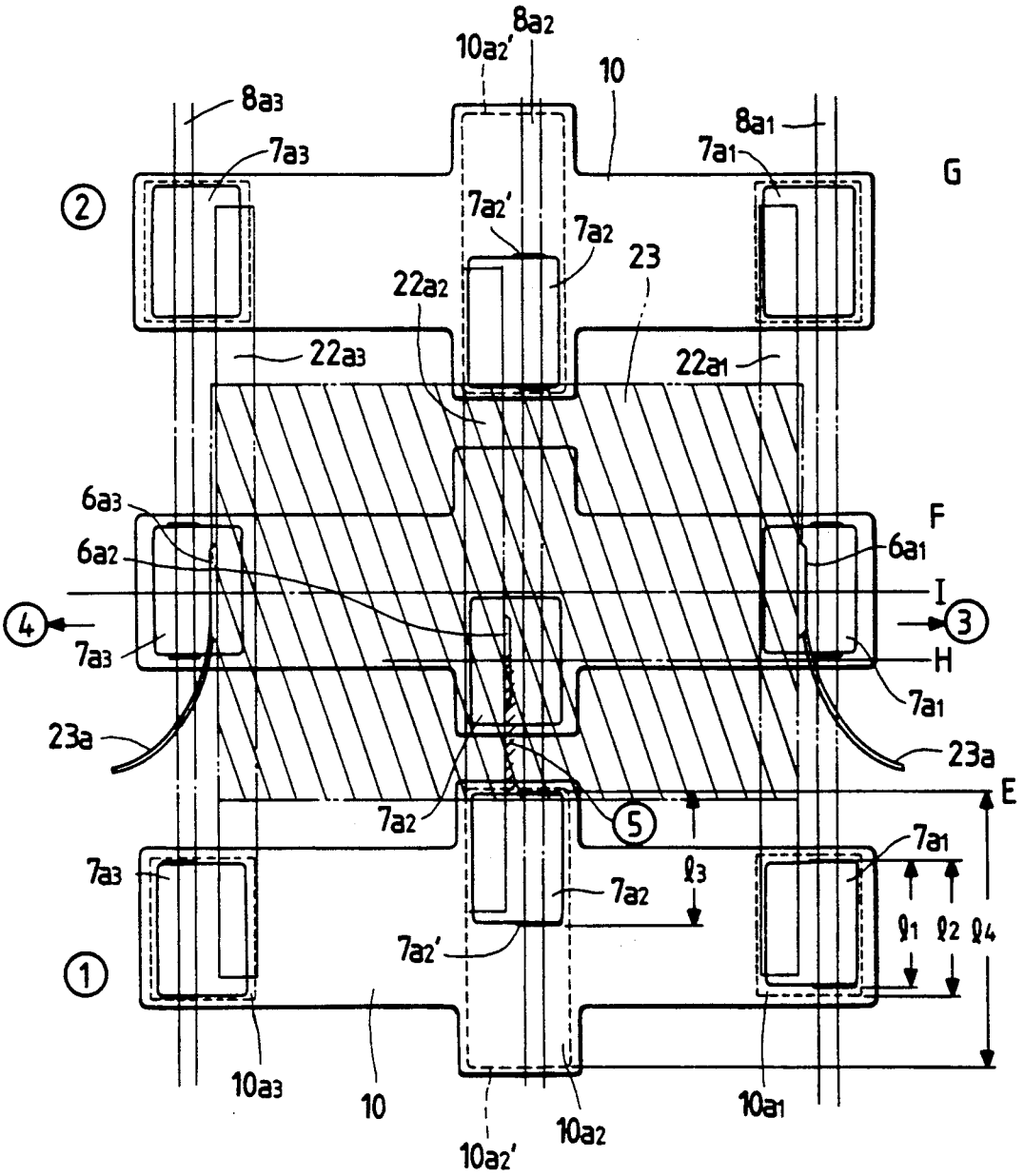
FIG. 8 is a schematic view showing the cutting operation for an article to be cut.

A position E in FIG. 8 indicates an initial position (a cutting start position to ①→② direction and a cutting end portion to ②→① direction), a position F indicates a cutting position, i.e., a position where the article is being cut, and a position G indicates a cutting end position (a cutting end position to ①→② direction and a cutting start position to ②→① direction). The cutter holders $7a_1$, $7a_2$, $7a_3$ are not aligned in a line perpendicular to the advancing direction thereof during the cutting operation. This will be explained regarding the position F shown in FIG. 8.

The apparatus in this embodiment serves to cut the article 23 at its both lateral edges and central portion. At both lateral edges of the article 23, during the cutting operation, non-used portions (scraps) 23a escape in directions ③ and ④ as the cutters $6a_1$, $6a_3$ advance to the ①→② direction. However, at the central portion of the article 23, even as the cutter $6a_2$ advances to the ①→② direction, since the article 23 is held down by the rubber roller $6b_2$ and the holder plate $19a_1$ during the cutting operation, the cut end (section) of the article 23 cannot escape in the direction ③ or ④, with the result that the section became rough or the article could not be cut correctly. Particularly, when the cutters $6a_1$, $6a_2$, $6a_3$ are aligned in a line laterally, the cutting operation is apt to be considerably inconvenient.

Thus, in the illustrated embodiment, the above inconvenience is eliminated by advancing the central cutter $6a_2$ later than the side cutters $6a_1$, $6a_3$. That is to say, in the push holder 10, there are provided the cavities $10a_1$, $10a_2$, $10a_3$ to cover the cutter holders $7a_1$, $7a_2$, $7a_3$, respectively. Among them, longitudinal dimensions $l_2$ of the side cavities $10a_1$, $10a_3$ are substantially the same as longitudinal dimensions $l_1$ of the cutter holders $7a_1$, $7a_3$. To the contrary, a longitudinal $l_4$ of the central cavity $10a_2$ is greater than a longitudinal dimensions $l_3$ of the cutter holder $7a_2$.

Accordingly, when the operator shifts the push holder 10 from the position E in FIG. 8 to the ①→② direction, the cutter holders $7a_1$, $7a_3$ are advanced generally simultaneously, but the cutter holder $7a_2$ is not shifted until an abutment end $10a_2'$ of the central cavity $10a_2$ is abutted against an abutment end $7a_2'$ of the cutter holder $7a_2$ In this way, it is possible to advance the cutter holder $7a_2$ later than the cutter holders $7a_1$, $7a_3$. Similarly, when the push holder 10 is shifted to the ②→① direction, the cutter holder $7a_2$ can be shifted later than the cutter holders $7a_1$, $7a_3$.

Next, at a position shown by the line I in FIG. 8, rubber rollers $6c_1$, $6c_3$ held by the cutter holders $7a_1$, $7a_3$ strongly hold down the holder plates $19a_1$, $19a_3$ which in turn hold down the article 23, thereby preventing the article 23 from being moved during the cutting operation. To the contrary, at a position shown by the line H, since the holder plates $19a_1$, $19a_3$ loosely hold down the article 23, when the central portion of the article 23 is cut by the cutter $6a_2$ held by the..cutter holder $1a_2$, a portion ⑤ of the article 23 confronting to the holder plate $19a_1$ can slightly escape toward the direction ③, thus permitting the smooth cutting of the article.

When the operator further shifts the push holder 10 to the ①→② direction to reach the position G in FIG. 8, the cutting operation is completed. When the cutting operation is finished, the operator may lift the frame 1 at that condition to remove the cut article 23 or may lift the frame 1 to remove the cut article 23 after he returns the push holder 10 from the position G to the position E in the ②→① direction. In this case, since the power switch 25 is turned OFF because of the disengagement of the urging member 1d from the switch, the article 23 has already been released from the adsorption effect of the electrostatic adsorption plate 24. The power switch 25 consists of a conventional momentary switch that is turned ON when once depressed and is turned OFF when depressed again and then released. Accordingly, the power switch is turned ON by the operator when the cutting operation is started, and is depressed again by the urging member 1d when the frame 1 is lowered. But, in this condition, the switch 25 remains the ON condition, thus not affecting the bad influence upon the adsorption of the article 23 during the cutting operation. After the cutting of the article 23 is finished, since the power switch is turned OFF upon lifting the frame 1, the adsorption effect of the electrostatic adsorption plate is lost, thus permitting the easy removal of the cut article 23.

Accordingly, during the positioning and cutting of the article 23, it is possible to prevent the shifting of the article 23 by means of the electrostatic adsorption plate 24.

Next, the operation of the cutter $6a_1$ during the cutting operation will be explained with reference to FIGS. 9A and 9B.

Figure 9B:
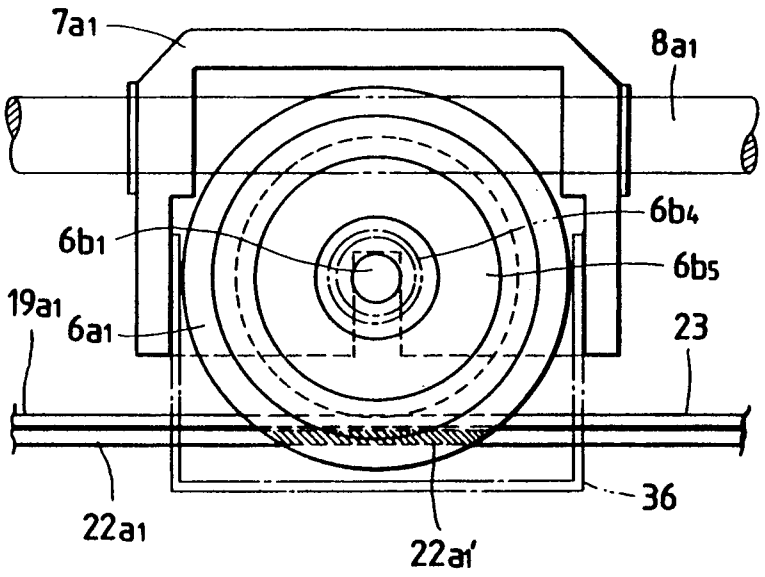
FIGS. 9A and 9B are views for explaining cutter members.
Figure 9A:
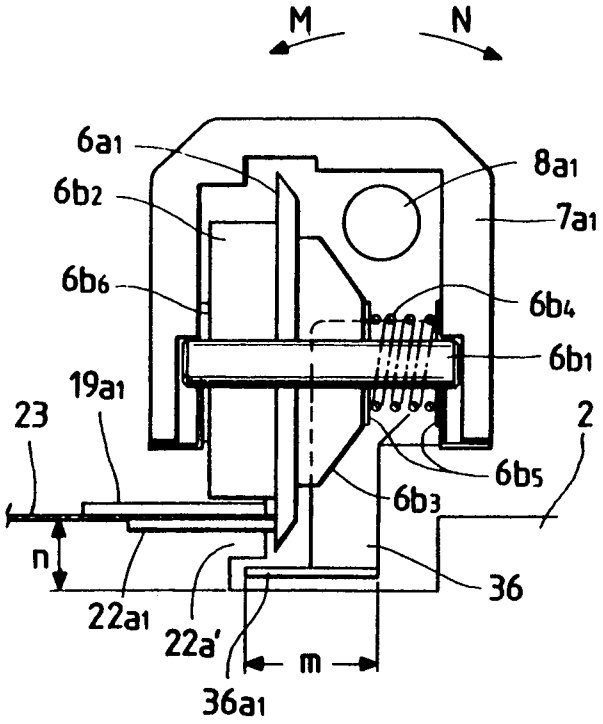

In FIG. 9A, during the cutting operation, since the rubber roller $6b_2$ urges the holder plate $19a_1$ against the guide member $22a_1$, the article 23 rested on the guide member $22a_1$ to be firmly fixed. Further, during the cutting operation, the rubber roller $6b_2$ advances while rolling on the holder plate $19a_1$, and thus, the cutter $6a_1$ also advances while rolling.

Further, since the end 36a of the safety plate 36 is entered below the end $22a_1'$ of the guide member $22a_1$ and the projection 2g of the support member 2 during the cutting operation, even if the operator tries to lift the frame 1 during the cutting operation, the end 36a is locked by the end $22a_1'$ to prevent the lifting of the frame 1. Conversely, in the condition that the frame 1 is lifted, even if the operator tries to lower the frame 1, since the end 36a is abutted against the end $22a_1'$, the frame cannot be completely lowered.

Accordingly, the safety plate 36 prevents the poor cutting operation of the cutter $6a_1$ caused by the accidental lifting of the frame 1 during the cutting of the article 23 and also prevents the accidental lowering of the frame 1 into the cutting position when the cutter $6a_1$ is stopped at the cutting position in the non-cutting condition.

Further, as mentioned above, since the cam members $13a_1'$, $13a_2'$, $13a_3$ and $13a_1'$, $13a_2'$, $13a_3'$ are provided at the cutter waiting positions on the frame 1, the cutter holders $7a_1$, $7a_2$, $7a_3$ are engaged by the cam members $13a_1$, $13a_2$, $13a_3$ at the position E in FIG. 8 and are engaged by the cam members $13a_1'$, $13a_2'$, $13a_3'$ at the position G. Due to these engagements, as shown in FIG. 9A, the cutter holders $7a_1$, $7a_2$ are rotated in a direction M around the guide rails $8a_1$, $8a_2$ and the cutter holder $7a_3$ is rotated in a direction N around the guide rail $8a_3$ to reach a condition shown in FIG. 11.

In this condition, the end 36a of the safety plate 36 does not interfere with the end $22a_1'$ of the guide member $22a_1$, thus protecting the cutter $6a_1$ and permitting the lifting or lowering of the frame 1. Further, in this condition, the spring force of the compression coil spring $6e_1$ acts on the inner surface of the cutter holder $7a_1$ via the washer $6f_1$.

After the cutting operation is started, when the operator shifts the push holder 10 toward the ①→② direction, the cutter holders are disengaged from the cam members $13a_1$, $13a_2$, $13a_3$. Consequently, by the elastic force of the rubber roller $6c_1$ which urged the holder plate $19a_1$, the cutter holder $7a_1$ is rotated in the direction N around the guide rail $8a_1$ to abut the cutter $6a_1$ against the end face $22a_1'$ of the guide member $22a_1$, with the result that the spring force of the compression coil spring $6e_1$ is received by the end face $22a_1'$ via the cutter $6a_1$. Similarly, the cutter $6a_2$ and $6a_3$ are rotated in the directions N and M, respectively, around the guide rails $8a_2$ and $8a_3$, respectively, to be abutted against the end faces $22a_2'$ and $22a_3'$ of the guide members $22a_2$ and $22a_3$, respectively.

Incidentally, if the cutter holders $7a_1$, $7a_2$, $7a_3$ are not abutted against the guide members $22a_1$, $22a_2$, $22a_3$ only by the elastic forces of the rubber rollers $6c_1$, $6c_2$, $6c_3$, additional cam members acting in directions opposite to those of the above-mentioned cam members $13a_1$, $13a_2$, $13a_3$ and $13a_1'$, $13a_2'$, $13a_3'$ may be provided in place. It is apparent that if there is any clearance between the cutters $6a_1$, $6a_2$, $6a_3$ and the guide members $22a_1$, $22a_2$, $22a_3$ the article 23 cannot be cut correctly. Thus, the cutters should be urged against the guide members with appropriate forces. For this purpose, springs may be provided.

When the cutting of the article 23 is finished, the push holder 10 reaches the position G in FIG. 8 where the cutter holders $7a_1$, $7a_2$, $7a_3$ are engaged by the cam members $13a_1'$, $13a_2'$, $13a_3'$, thus disengaging the end 36a from the end $22a_1'$ again. As a result, it is possible to lift the frame 1 for removing the cut article 23.

Figure 10C:
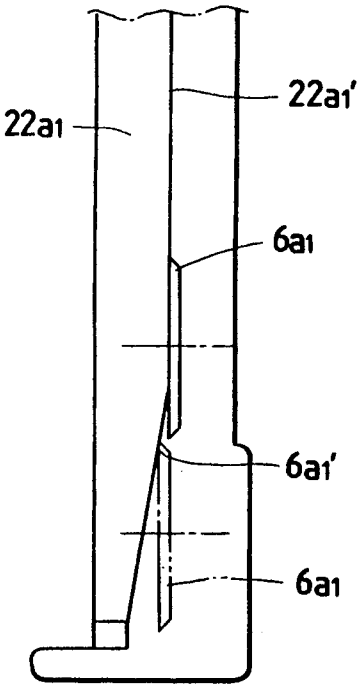
FIGS. 10A to 10C are views for explaining a guide member.
Figure 10B:
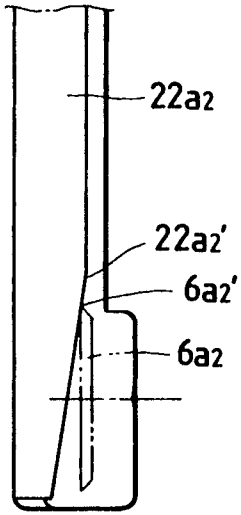
Figure 10A:
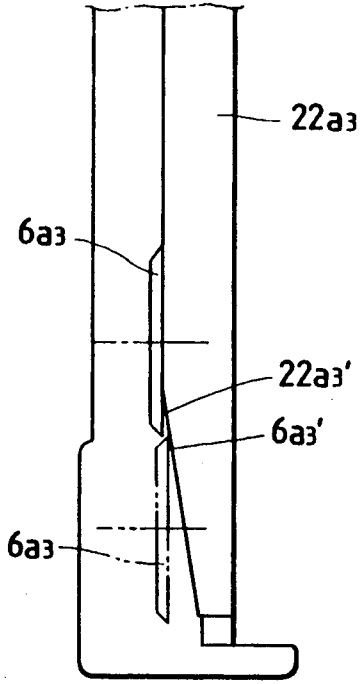

In the illustrated embodiment, the cutters $6a_1$, $6a_2$, $6a_3$ are spaced apart from the guide members $22a_1$, $22a_2$, $22a_3$ by providing the cam members $13a_1$, $13a_2$, $13a_3$ and $13a_1'$, $13a_2'$, $13a_3'$ on the frame 1. However, in place of the provisions of the cam members, the configurations of the guide members $22a_1$, $22a_2$, $22a_3$ may be changed to tapered shapes as shown in FIGS. 10A to 10C so that the cutters $6a_1$, $6a_2$, $6a_3$ are spaced apart from the guide members $22a_1$, $22a_2$, $22a_3$ at the cutting start position (position E in FIG. 8) and at the cutting end position (position G in FIG. 8). However, in this case, at the position E in FIG. 8, since the end faces $22a_1'$, $22a_2'$, $22a_3'$ of the guide members $22a_1$, $22a_2$, $22a_3$ are tapered, the cutter blades $6a_1'$, $6a_2'$, $6a_3'$ of the cutters $6a_1$, $6a_2$, $6a_3$ are not contacted with the guide members $22a_1$, $22a_2$, $22a_3$. From this condition, when the push holder 10 is shifted, as shown in FIGS. 10A to 10C, the cutter blades $6a_1'$, $6a_2'$, $6a_3'$ of the cutters $6a_1$, $6a_2$, $6a_3$ are contacted with the end faces $22a_1'$, $22a_2'$, $22a_3'$ of the guide members $22a_1$, $22a_2$, $22a_3$. When the push holder 10 is further shifted, since the cutter blades $6a_1'$, $6a_2'$, $6a_3'$ are shifted while slidingly contacting with the end faces $22a_1'$, $22a_2'$, $22a_3'$, it is feared that the cutter blades $6a_1'$, $6a_2'$, $6a_3'$ are damaged.

To the contrary, in the illustrated embodiment, when the cutters $6a_1$, $6a_2$, $6a_3$ are urged against the end faces $22a_1'$, $22a_2'$, $22a_3'$ of the guide members $22a_1$, $22a_2$, $22a_3$, since the cutters are totally urged against the guide members as shown in FIG. 9B, the effective cutting can be performed without damaging the cutter blades.

Next, a locking the unlocked mechanism for the push holder 10 will be explained when the frame 1 is lifted or lowered.

When the push holder 10 is in the position E in FIG. 8, as the frame 1 is lifted, the push holder 10 is slid down in the direction P in FIG. 3, thus worsening the cutting operation in the ①→② direction. Thus, in the illustrated embodiment of the present invention, there is provided a locking mechanism as will be described hereinbelow.

The bearings $9a_1$, $9a_2$, $9a_3$ and $9a_1'$, $9a_2'$, $9a_3'$ for the guide rails $8a_1$, $8a_2$, $8a_3$ are provided on the frame 1. On the other hand, the lock arms 12, 12' are rotatably held by the holding members 11, 11' on the push holder 10. The holding members 11, 11' are biased toward the direction Q (FIG. 4) by means of springs (not shown) to abut against the upper surface of push holder 10. The lock arms 12, 12' prevent the movement of the push holder 10 to the direction P by engaging with the high friction members 12a, 12a' on the bearings $9a_1'$, $9a_3'$.

When the frame 1 is rotated to be lowered on the support member 2 as shown in FIG. 4, the free ends of the lock arms 12, 12' are abutted against the lock releasing pins 2g, 2g' to rotate the lock arms 12, 12' in a direction opposite to the direction Q, thus disengaging the lock arms 12, 12' from the bearings $9a_1'$, $9a_3'$ to permit the movement of the push holder 10.

Further, in FIG. 8, when the push holder 10 is shifted to the ②→① direction, as shown in FIG. 4, since the free ends of the lock arms 12, 12' ride on the inclined surfaces $9a_4'$ of the bearings $9a_1'$, $9a_3'$, the push holder 10 becomes the shiftable condition. In this point, when the frame 1 is rotated in the direction B, since the high friction members 12*a*, 12*a'* attached to the lock arms 12, 12' are engaged by the bearings $9a_1'$, $9a_3'$, it is possible to prevent the push holder 10 from sliding down in the direction P.

Next, the operation of the second aligners 27, 27' will be explained with reference to FIGS. 12A, 12B and 3.

As mentioned above, the operator rests the article 23 to be cut on the support member 2 while positioning the article by abutting it against the first aligner 26 and the second aligners 27, 27', and then depresses the power switch 25 to fix the article 23 on the electrostatic adsorption plate 24 of the support member, and then rotates and lowers the frame 1 in the direction A in FIG. 3. In this case, the slide plate 34 is shifted to the direction R in FIG. 2.

As the slide plate 34 is shifted to the direction R, the rack 33 hold by the slide plate 34 is also shifted to the direction R, meanwhile the rack is engaged by the gear 30. As the slide plate 34 is further shifted to the direction R, the gear 30 is rotated by a driving force from the rack 33, thus rotating the slide gear 31 meshed with the gear 30 in the direction J in FIG. 12A in opposition to the spring force of the spring 32.

Figure 12A:
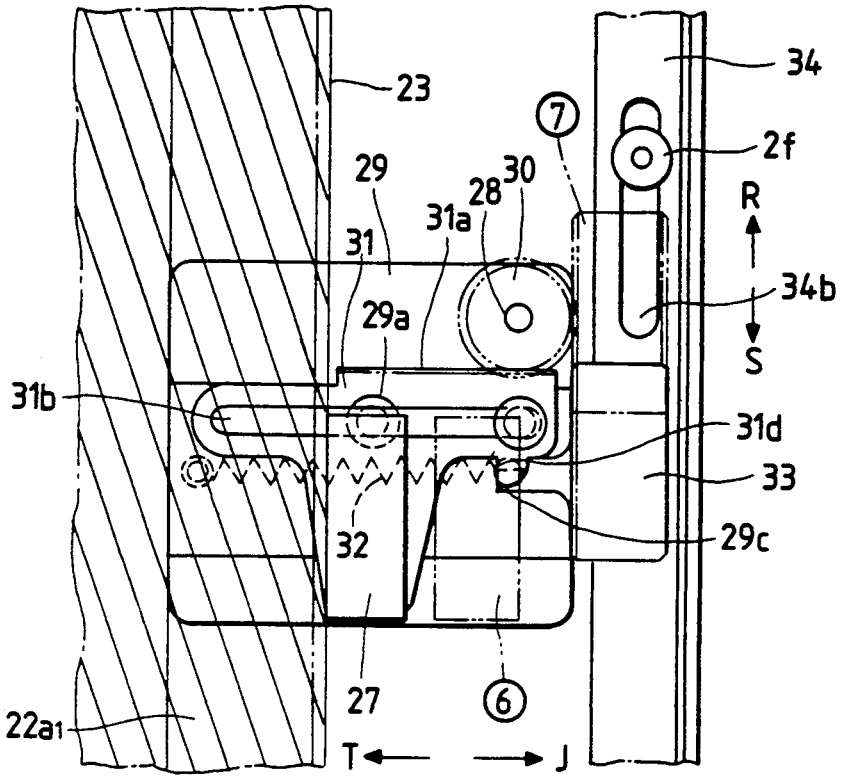
FIGS. 12A and 12B are explanatory views for explaining aligners.
Figure 12B:
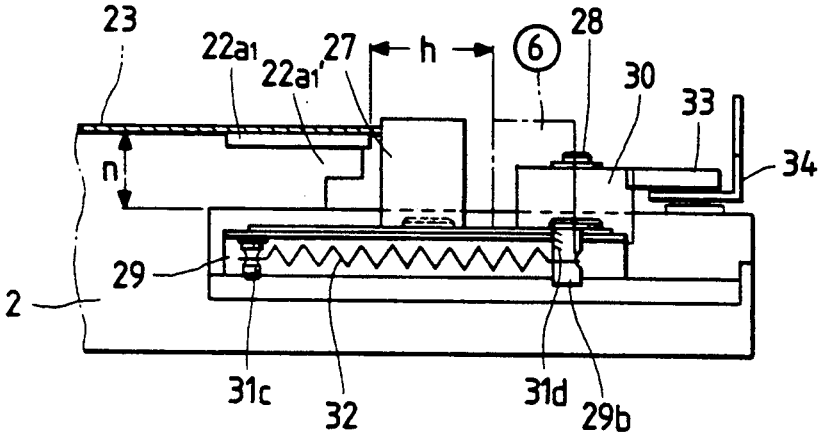
Figure 13:
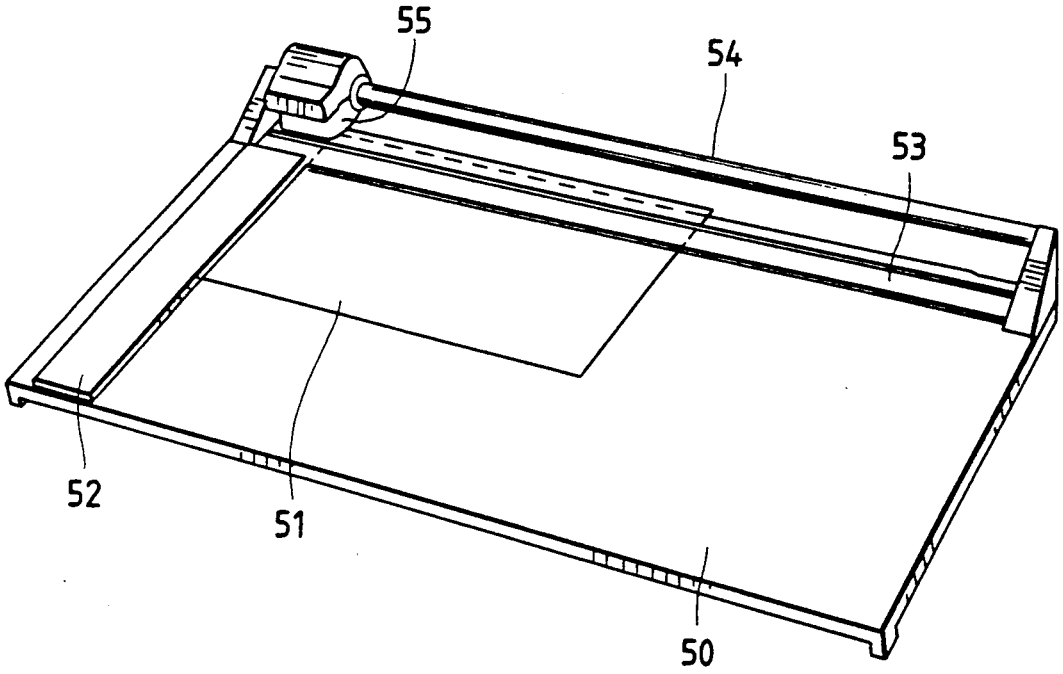
FIG. 13 is a perspective view of a conventional cutting apparatus.

When the frame is further rotated to reach the condition shown in FIG. 2, as shown in FIG. 12A, the second aligners 27, 27' are shifted to positions ⑥ and the rack 33 is shifted to a position ⑦. As a result, as shown in FIG. 12B, a space having a height n and a width h is created. However, this space is smaller than a space having a height n and a width m as shown in FIG. 9A, the cutter $6a_1$ and the safety plate 36 can pass through this space without trouble.

To the contrary, when the frame 1 is rotated from the condition shown in FIG. 4 in the direction B to lift it as shown in FIG. 3, the slide plate 34 is shifted to the direction S, thus disengaging the racks 33, 33' from the gears 30, 30', with the result that the slide gears 31, 31' which were biased toward the direction T by the springs 32 are shifted until the bent ends 31*d*, 31*d'* are abutted against the notches 29*c*, 29*c'*. Accordingly, in the condition that the frame 1 is lowered as shown in FIG. 4, the second aligners 27, 27' have been retarded to the direction J, thus permitting the passage of the cutter $6a_1$ to permit the cutting of the article 23.

Next, a mechanism for shifting the slide plate 34 in response to the rotation of the frame 1 will be explained with reference to FIG. 4.

As shown in FIG. 4, a rotary lever 35 is rotatably mounted on the rotary shaft 3 supported by the bearings $1a_1$, $1a_2$, $1a_3$. A pin 35*a* protruded from a free end of the rotary lever 35 is engaged by a cam recess 34*a* formed in the slide plate 34. Further, elongated slots 34*b* are formed in the slide plate 34 at predetermined positions, by which guide pins 2*f* formed on the support member 2 are engaged. Thus, in response to the rotation of the frame 1, the slide plate 34 can be shifted to the direction S or R via the rotary lever 35, as shown in FIG. 4.

Incidentally, there are the three elongated slots 34*b* by which the three guide pins 2*f* are engaged, respectively. Since the slide plate is shifted while being guided by these guide pins in the elongated slots, the second aligners 27, 27' are shifted in the directions T, J in FIG. 2 smoothly without any play.

As mentioned above, the article 23 can be positioned along its longitudinal and transverse directions by means of the first and second aligners 26, 27, 27' and can be correctly cut for a short time.

In the illustrated embodiment, while an example that the cutters are constituted by the cutter blades formed on peripheral surfaces of rotary members was explained, the present invention is not limited to this example, but the cutters may be non-rotatably fixed to the cutter holders.

What is claimed is:

1. A sheet cutting apparatus, comprising:

a holding member for holding a sheet;

a plurality of cutting means for cutting the sheet held by said holding member, disposed to be shiftable in a first direction relative to the sheet, said plurality of cutting means being separated from each other in a second direction orthogonal to the first direction; and shifting means for shifting said plurality of cutting means in the first direction to cause one of said plurality of cutting means to be offset from the remainder of said plurality of cutting means in the first direction, said shifting means causing said plurality of cutting means to form a plurality of parallel cuts in the sheet.

2. A cutting apparatus according to claim 1, wherein said holding member includes an adsorption means for adsorbing the sheet.

3. A cutting apparatus according to claim 2, wherein said adsorption means adsorbs the sheet by an electrostatic force.

4. A cutting apparatus according to claim 1, wherein said plurality of cutting means comprise rotary members having cutter blades at their peripheries.

5. A cutting apparatus according to claim 4, wherein said rotary members cut the sheet while rotating.

6. A cutting apparatus according to claim 4, wherein said cutting means include members for holding said rotary members.

7. A cutting apparatus according to claim 6, wherein said shifting members engages said members.

8. A cutting apparatus according to claim 4, further including guide members for guiding said rotary members while slidingly contacting the latter.

9. A cutting apparatus according to claim 8, wherein said rotary members are not contacted with said guide members when said rotary members are positioned not to cut the sheet.

10. A cutting apparatus according to claim 1, wherein said shifting member has a plurality of abutment portions which are abutted against said plurality of cutting means, respectively, and said plurality of abutment portions are not aligned in a line perpendicular to the advancing direction of said cutting means.

11. A cutting apparatus according to claim 1, further including a plurality of guide means for guiding said plurality of cutting means, respectively.

12. A cutting apparatus according to claim 1, further including an urging means for urging the sheet against said holding member.

13. A sheet cutting apparatus comprising:

a holding member for holding a sheet;

a plurality of cutting means for cutting the sheet held by said holding means, disposed to be shiftable in a first direction relative to the sheet, said plurality of cutting means being separated from each other in a second direction orthogonal to the first direction;

shifting means for shifting said plurality of cutting means in the first direction to cause one of said plurality of cutting means to be offset from the remainder of said plurality of cutting means in the first direction, said shifting means causing said plurality of cutting means to form a plurality of parallel cuts in the sheet; and support means for supporting said shifting means as said shifting means shifts between an operating position where said plurality of cutting means are opposed to said holding member to cut the sheet, and a non-operating position where said plurality of cutting means are spaced form said holding member.

14. A cutting apparatus according to claim 13, further including a safety member positioned beneath a cutter blade of said plurality of cutting means when said shifting means is shifted to said non-operating position.

15. A cutting apparatus according to claim 13, further including a prohibiting means for preventing said shifting means from being shifted to said non-operating position when said plurality of cutting means are cutting the sheet held by said holding member.

16. A cutting apparatus according to claim 13, further including a locking means for locking said cutting means so that said cutting means are not shifted by said shifting means.

17. A cutting apparatus according to claim 13, wherein said holding member includes an adsorption means for adsorbing the sheet.

18. A cutting apparatus according to claim 17, wherein said holding member includes an adsorption means for adsorbing the sheet.

19. A cutting apparatus according to claim 13, further including a positioning means for positioning the sheet held by said holding member when said shifting means is in said non-operating position.

20. A cutting apparatus according to claim 19, wherein said positioning means is shifted to a position where it does not position the sheet, when said shifting means is shifted from said non-operating position to said first position.

* * * * *

UNITED STATES PATENT AND TRADEMARK OFFICE

CERTIFICATE OF CORRECTION

PATENT NO. : 5,303,626

DATED : April 19, 1994

INVENTOR(S) : TSUKASA UEHARA, ET AL.

It is certified that error appears in the above-indentified patent and that said Letters Patent is hereby corrected as shown below: Title page, Item: [57] ABSTRACT, line 3, "member" should read --members--;
line 5, "member," should read --members,--; and
line 6, "member" should read --members--.

Column 2, line 57, "$9a_1$, $9a_2$," should read --$9a_1$', $9a_2$',--; and
line 61, "$10a_3$" should read --$10a_3$.--.

Column 3, line 19, "$13a_1$" (second occurrence) should read --$13a_3$--; and
line 64, "$6a_3$" should read --$6a_3$.--.

Column 5, line 66, "$19a_1$" should read --$19a_2$--.

Column 6, line 22, "$7a_2$" should read --$7a_2$.--;
line 35, "the..cutter" should read --the cutter--;
line 37, "$1a_2$," should read --$7a_2$,--; and
line 38, "$19a_1$," should read --$19a_2$--.

UNITED STATES PATENT AND TRADEMARK OFFICE

CERTIFICATE OF CORRECTION

PATENT NO. : 5,303,626
DATED : April 19, 1994
INVENTOR(S) : TSUKASA UEHARA, ET AL.

It is certified that error appears in the above-indentified patent and that said Letters Patent is hereby corrected as shown below:

Column 7,
line 31, "$13a_1'$, $13a_2'$, $13a_3'$" (first occurrences) should read --$13a_1$, $13a_2$, $13a_3$--.

Column 10,
line 45, "members" should read --member--.

Column 11,
line 16, "form" should read --from--.

Column 12,
line 12, "holding member includes an adsorption" should read--adsorption means adsorbs the sheet by an electrostatic force.--; and
line 13, entire line should be deleted.

Signed and Sealed this

Eleventh Day of October, 1994

*Attest:*

Bruce Lehman

BRUCE LEHMAN

*Attesting Officer*

*Commissioner of Patents and Trademarks*